US005480372A

United States Patent [19]

Gwiazdon et al.

[11] Patent Number: 5,480,372

[45] Date of Patent: Jan. 2, 1996

[54] APPARATUS FOR FOLDING AND LOADING MICROWAVE POPCORN BAGS INTO A FIXTURE

[75] Inventors: Rodney K. Gwiazdon, St. Louis Park, Minn.; John E. Korte, Cedar Rapids, Iowa; Richard S. Deadmond, West Bend; Wayne A. Smith, Shorewood, both of Wis.

[73] Assignee: General Mills, Inc., Minneapolis, Minn.

[21] Appl. No.: 164,740

[22] Filed: Dec. 10, 1993

[51] Int. Cl.[6] ..... B31F 7/00; B65B 63/04

[52] U.S. Cl. ..... 493/437; 493/457; 493/316; 493/444; 271/11; 271/102; 271/106

[58] Field of Search ..... 493/123–127, 493/250, 437, 449, 444, 457, 315, 316, 317; 291/11, 22, 99, 100, 102, 106, 107

[56] References Cited

U.S. PATENT DOCUMENTS

| | | | |
|---|---|---|---|
| 1,071,853 | 8/1913 | Young | 493/444 |
| 1,249,042 | 12/1917 | Dexter et al. | 271/107 |
| 1,886,552 | 11/1932 | Joplin | 53/284.7 |
| 1,909,319 | 5/1933 | Taylor | 53/284.7 |
| 2,364,543 | 12/1944 | Moore | 53/482 |
| 2,925,695 | 2/1960 | Fry | 53/482 |
| 2,952,959 | 9/1960 | Piazze | 53/284.7 |
| 3,462,070 | 8/1969 | Corella . | |
| 3,493,226 | 12/1969 | Weir | 493/449 |
| 3,503,179 | 3/1970 | Pierre | 53/386.1 |
| 3,570,751 | 3/1971 | Trewella | 383/207 |
| 3,608,709 | 9/1971 | Pike | 266/219 |
| 3,615,711 | 10/1971 | Markus et al. | 426/110 |
| 3,632,104 | 1/1972 | Dufour | 493/444 |
| 3,720,559 | 3/1973 | Odom et al. | 53/482 |
| 3,745,892 | 7/1973 | Ganz | 493/125 |
| 3,788,035 | 1/1974 | Geisel | 53/282 |
| 3,854,385 | 12/1974 | Wallin | 493/124 |
| 3,955,334 | 4/1976 | Wild et al. | 53/29 |
| 4,019,305 | 4/1977 | McGhie et al. | 53/482 |
| 4,033,093 | 7/1977 | Mencacci | 53/571 |
| 4,061,327 | 12/1977 | Blessing | 493/457 |
| 4,084,391 | 4/1978 | Williams et al. | 493/457 |
| 4,108,300 | 8/1978 | Hayase et al. | 53/386.1 |
| 4,201,118 | 5/1980 | Calvert | 493/125 |
| 4,257,209 | 3/1981 | Tetenborg et al. | 53/375.7 |
| 4,257,210 | 3/1981 | Tetenborg et al. | 53/375.7 |
| 4,320,615 | 3/1982 | Gmur | 53/386.1 |
| 4,337,862 | 7/1982 | Suter | 383/211 |
| 4,348,853 | 9/1982 | Morse et al. | 53/571 |

(List continued on next page.)

FOREIGN PATENT DOCUMENTS

| | | | |
|---|---|---|---|
| 569335A | 5/1993 | European Pat. Off. . | |
| 565303 | 11/1932 | Germany . | |
| 635952 | 9/1936 | Germany . | |
| 2714584 | 11/1978 | Germany . | |
| 8213834 | 5/1981 | Germany | 53/567 |
| 0002123 | 1/1978 | Japan | 493/457 |
| 9315976 | 8/1993 | WIPO . | |

*Primary Examiner*—Jack W. Lavinder
*Assistant Examiner*—Christopher W. Day
*Attorney, Agent, or Firm*—L. MeRoy Lillehaugen; John A. O'Toole; Alan D. Kamrath

[57] ABSTRACT

The front bag (12) of a supply of bags (12) stored in a magazine (250) is removed by an unloading device (252) including four linkages (254, 256, 258, 260) which are pivoted to attach suction cups (264) thereto. The unloading device (252) inserts the bag (12) between nip rollers (52, 54) including spaced wheels (56, 58) which drive the bag (12) downward until the closed end (20) rests upon an adjustable stop (72). A tucking plate (90) moves from a retracted position to an extended position generally perpendicular to the bag (12) to drive the bag (12) into a slot (46) of a fixture (32), with the bag (12) having a U-shaped configuration around the tucking plate (90). The bag (12) is prevented from moving from the slot (46) with the tucking plate (90) as the tucking plate (90) moves from the extended position to the retracted position by a compression roller (208) pivotable by a cam (214) movable with the tucking plate (90) to sandwich the side edges of the bag (12).

31 Claims, 6 Drawing Sheets

U.S. PATENT DOCUMENTS

| | | | |
|---|---|---|---|
| 4,450,180 | 5/1984 | Watkins | 426/107 |
| 4,548,826 | 10/1985 | Watkins | 426/394 |
| 4,604,854 | 8/1986 | Andreas | 53/552 |
| 4,621,480 | 11/1972 | Aiuola et al. | 53/234 |
| 4,669,249 | 6/1987 | Aiuola et al. | 53/234 |
| 4,691,374 | 9/1987 | Watkins et al. | 383/104 |
| 4,735,513 | 4/1988 | Watkins et al. | 383/116 |
| 4,845,924 | 7/1973 | Focke et al. | 53/234 |
| 4,861,325 | 9/1989 | DiMarzio | 493/124 |
| 4,873,815 | 10/1989 | Tetenborg et al. | 53/571 |
| 4,878,765 | 11/1989 | Watkins et al. | 383/116 |
| 4,890,439 | 1/1990 | Smart et al. | 53/410 |
| 5,044,777 | 9/1991 | Watkins et al. | 383/100 |
| 5,171,950 | 12/1992 | Brauner et al. | 219/727 |
| 5,180,357 | 1/1993 | Marzullo | 493/420 |
| 5,269,117 | 12/1993 | Boriani et al. | 53/234 |

5
5

10
54
52
274
60
64
62
276
68
22
22
16
12
12
49
66
14
14
20
50
16
48
32
70
216
91
88
86
208
49
92
90
94
204
84
72
48
46
82
210
32
30
80
76
100
20
74

APPARATUS FOR FOLDING AND LOADING MICROWAVE POPCORN BAGS INTO A FIXTURE

BACKGROUND

The present invention generally relates to apparatus for folding and loading bags, particularly to apparatus for folding and loading bags for food products, and specifically to apparatus for folding and loading microwave popcorn bags.

Popcorn is a highly popular snack food item. In the past, the at-home preparation of popcorn by the consumer involved adding kernel popcorn plus a cooking oil to a covered pot and heating until the popcorn kernels popped to make popcorn. As used herein, "kernel popcorn" refers to unpopped popcorn. The noun "popcorn" or synonymously "popped popcorn" refers herein to popped kernel popcorn. The adjective "popcorn" can refer to either.

More recently, microwave popcorn products have become extremely popular. At present, in the United States of America, over 70 different brands of microwave popcorn products are available. In general, the more popular microwave popcorn products comprise an expandable paper bag containing a charge of kernel popcorn, fat and salt. The microwave popcorn article is adapted to be heated in a microwave oven for three to five minutes to produce the popped popcorn. More recently, improved microwave popcorn articles have been fabricated employing a metallized susceptor which facilitates the heating of the popcorn-fat charge and which, in turn, leads desirably to increases in popcorn volume and decreases in unpopped kernels. Microwave popcorn articles of this type are described in detail in, for example, U.S. Pat. No. 4,450,180 (issued May 22, 1984 to J. D. Watkins and incorporated herein by reference).

The prior art is replete with various apparatus and methods for filling and sealing microwave popcorn bags and in some cases folding the bag generally into a central portion having first and second wing portions extending from opposite ends thereof from folds. For example, U.S. Pat. Nos. 4,450,180; 4,548,826; 4,604,854; and 5,171,950 show techniques for filling and sealing microwave popcorn bags. Particularly, the charge of popcorn, fat and salt could be dropped as a prefabricated toroid- or doughnut-shaped piece into an open end of the bag prior to its sealing. More recently, the popcorn, fat in the form of a slurry, and salt are filled in the open end of the bag prior to its sealing. However, changes in the marketing of microwave popcorn have created demand for improved techniques for folding and loading microwave popcorn bags. Specifically, with the increasing competitiveness of the microwave popcorn business, a need exists for apparatus and methods which achieve higher output speeds in "bags per minute" while reducing the amount of labor, downtime, and floor space required. Additionally, with the reduction in the amount of material and/or layers utilized in the formation of paper popcorn packages including a microwave susceptor such as shown and described in International Publication No. WO 93/15976 published on Aug. 19, 1993, a need exists for apparatus and methods which are capable of running bags of flimsy construction as well as reducing product and material damage. Additionally, with the introduction of various types and sizes of bags to meet particular market types and conditions and for enhancing product performance, a need exists for apparatus and methods which are capable of handling different sizes of bags such as single or multiple serving sizes, and/or different types such as gusseted or non-gusseted bags, and/or different configurations of bags.

SUMMARY

The present invention solves these needs and other problems in the field of folding and/or loading microwave popcorn bags or the like by providing, in the most preferred form, a device including a tucking plate movable from a retracted position to an extended position for driving a bag positioned generally perpendicular to a slot of a fixture into the slot and creating a fold in the bag with the bag having a U-shaped configuration around the tucking plate.

In another aspect of the present invention, a bag is prevented from moving from a fixture with a tucking plate moving from an extended position to a retracted position, with the tucking plate driving the bag into the fixture when moving from the retracted position to the extended position.

In a further aspect of the present invention, a front bag is removed from a magazine by pivoting four linkages of a linkage assembly interconnected by their ends, with the first of the linkages being C-shaped and pivotally mounted about an axis intermediate its ends, and with members for releasably attaching to the front bag carried by another of the linkages.

In other aspects of the present invention, the bag is fed by nip rollers including spaced wheels which abut and roll on each other for engaging the bag intermediate the side edges and the folds of the bag.

Additionally, an aspect of the present invention includes a bottom stop for abutting with the lower end of the bag which is adjustable by a rack gear secured to the bottom stop and in gearing relation with a spur gear.

It is thus an object of the present invention to provide a novel apparatus for loading bags into a fixture.

It is further an object of the present invention to provide such a novel bag-loading apparatus achieving higher output speeds in "bags per minute" than current technology.

It is further an object of the present invention to provide such a novel bag-loading apparatus providing positive control of the bags during folding and loading.

It is further an object of the present invention to provide such a novel bag-loading apparatus capable of running various types and sizes of bags including gusseted and non-gusseted bags, multi- or single-ply paper bags, or bags of flimsy-type structure.

It is further an object of the present invention to provide such a novel bag-loading apparatus which is very compact, minimizing floor surface and work space required.

It is further an object of the present invention to provide such a novel bag-loading apparatus which is easily accessible from the floor for trouble shooting, maintenance, and the like.

It is further an object of the present invention to provide such a novel bag-loading apparatus allowing easy changeover for different sized bags and for reducing down time.

It is further an object of the present invention to provide such a novel bag-loading apparatus reducing product loss.

These and further objects and advantages of the present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
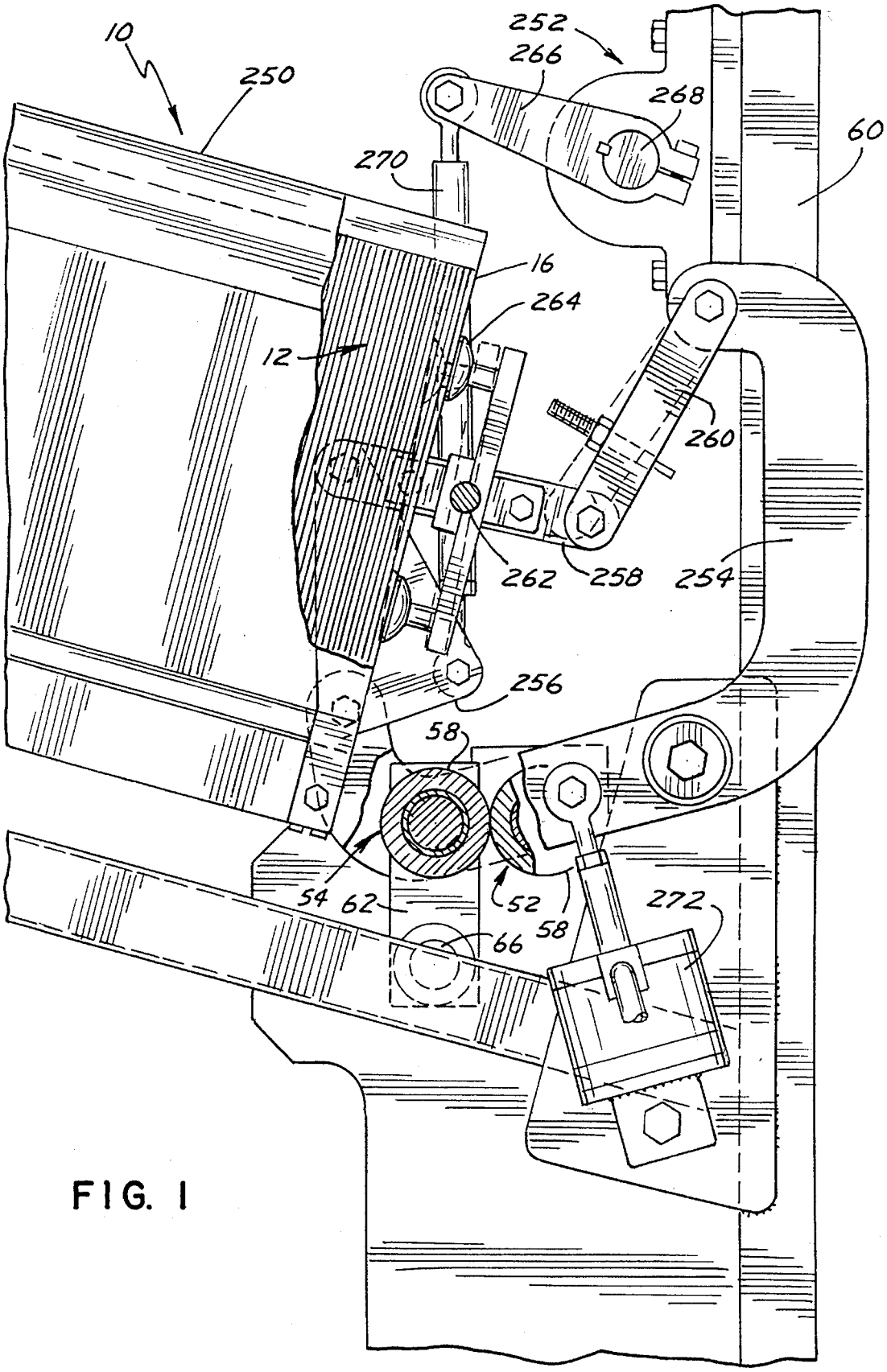
FIG. 1 shows a side view of a microwave popcorn bag folding and loading device according to the preferred away to show constructional details.
Figure 2:
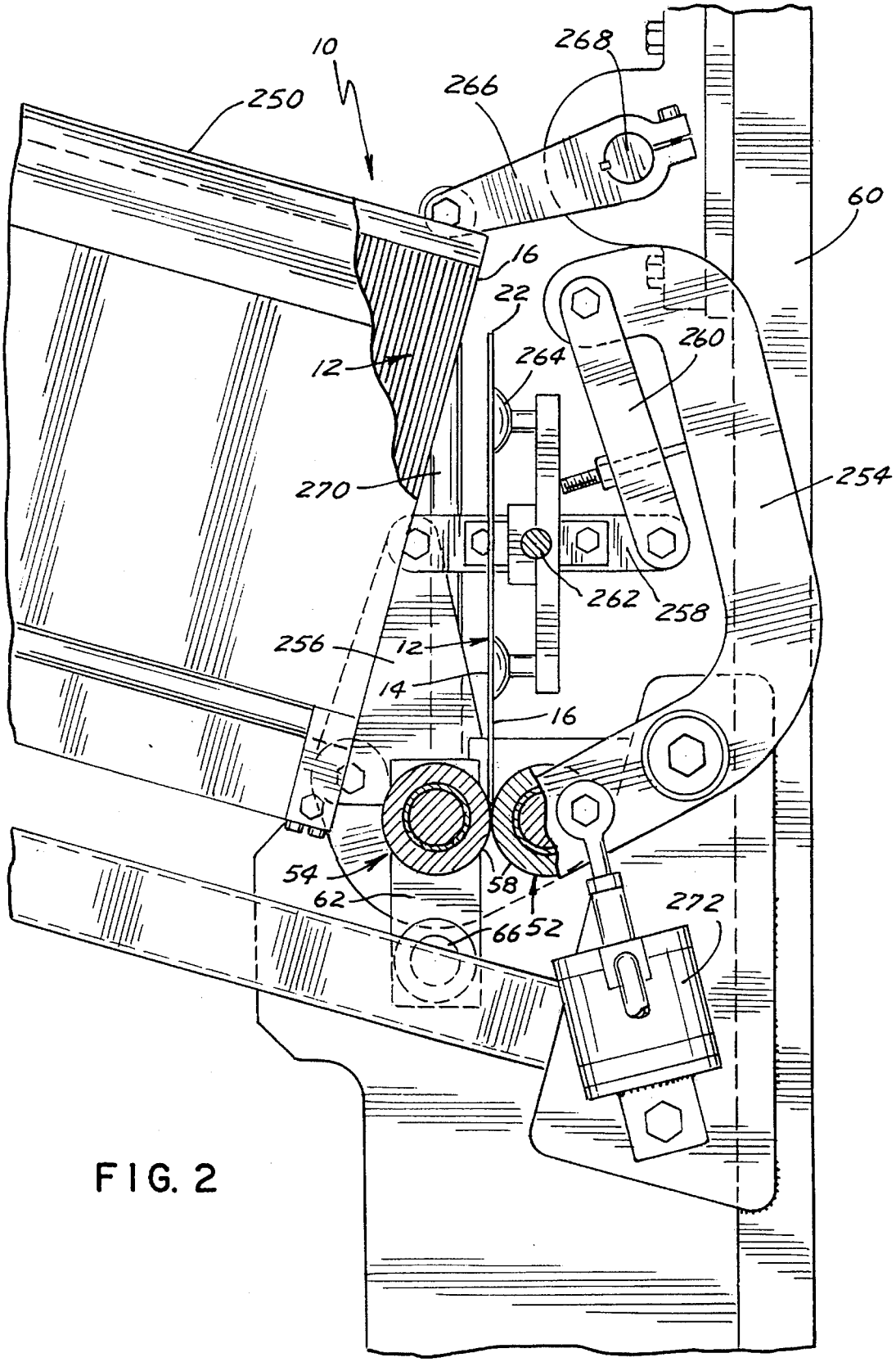
FIG. 2 shows a side view of the microwave popcorn bag folding and loading device of FIG. 1 in a different position, with portions broken away to show constructional details.
Figure 3:
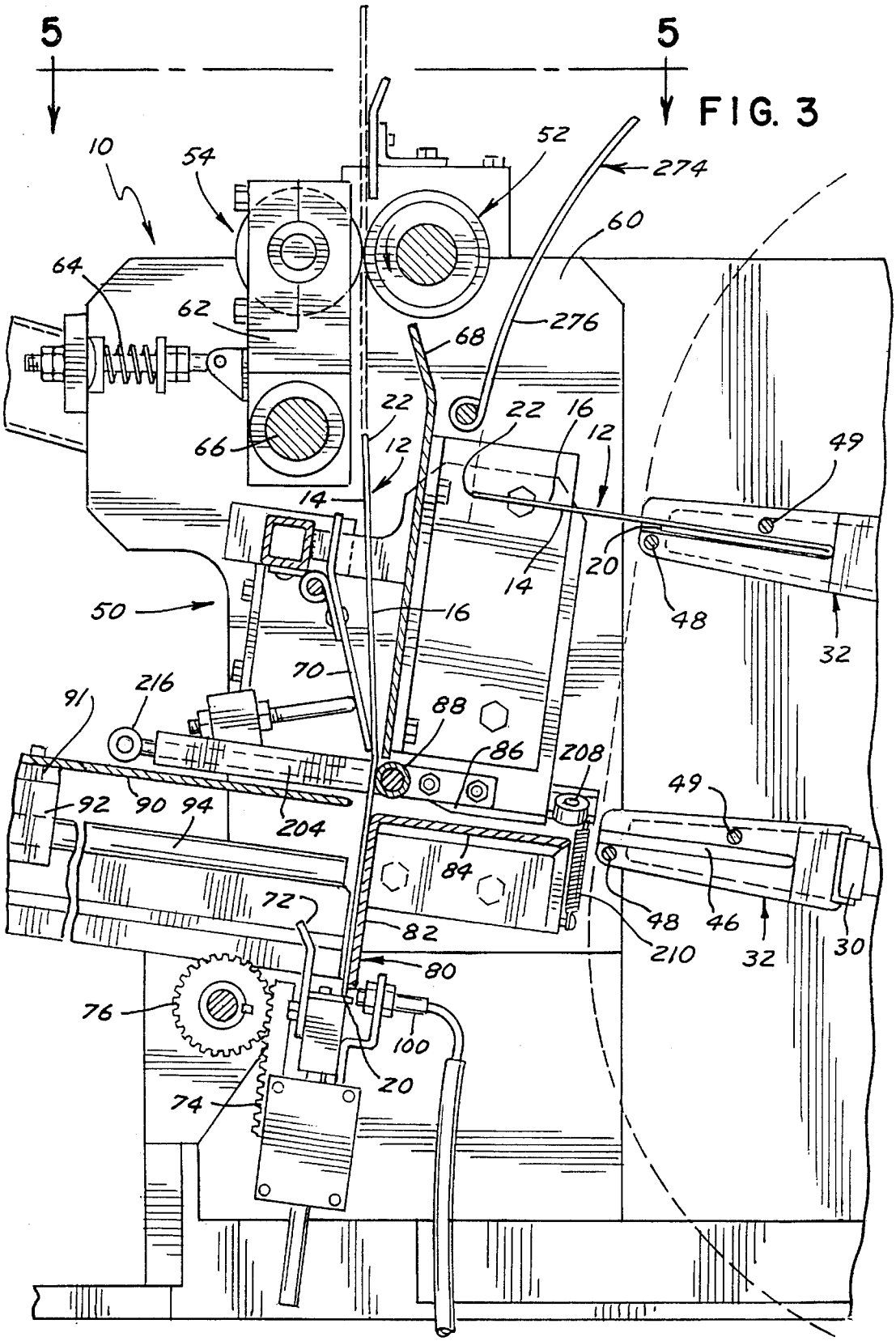
FIG. 3 shows a cross-sectional view of the microwave popcorn bag folding and loading device of FIG. 1.

All figures are drawn for ease of explanation of the basic teachings of the present invention only; the extensions of the Figures with respect to number, position, relationship, and dimensions of the parts to form the preferred embodiment will be explained or will be within the skill of heart after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "front", "back", "rear", "upper", "lower", "height", "width", "end", "side", "horizontal", "vertical", and similar terms are used herein, it should be understood that these terms have reference only to the structure shown in the drawings as it would appear to a person viewing the drawings and are utilized only to facilitate describing the invention.

DESCRIPTION

An apparatus for folding and loading bags 12 according to the preferred teachings of the present invention is shown in the drawings and generally designated 10. In the most preferred form, bags 12 are of the current type for the marketing of microwave popcorn and each include a top 14, a bottom 16 including the microwave susceptor, first and second gusseted sides 18, a first, lower, sealed end 20, and a second, upper, unsealed end 22. In the most preferred form, bottom 16 has a width less than top 14. Each side 18 includes a top gusset pivotally connected to top 14 about a fold line and includes a bottom gusset pivotally connected to bottom 16 about a fold line and also pivotally connected to the corresponding top gusset. It should be noted that bags 12 can be of other types and varieties than bags 12 as shown, such as but not limited to bags 12 where top 14 and bottom 16 are of equal or different widths, nongusseted bags 12, or the like. Also, bags 12 can be formed of various types of materials including paper of either multi-ply or single-ply variety, plastic, and like materials including flimsy-type materials.

Figure 4:
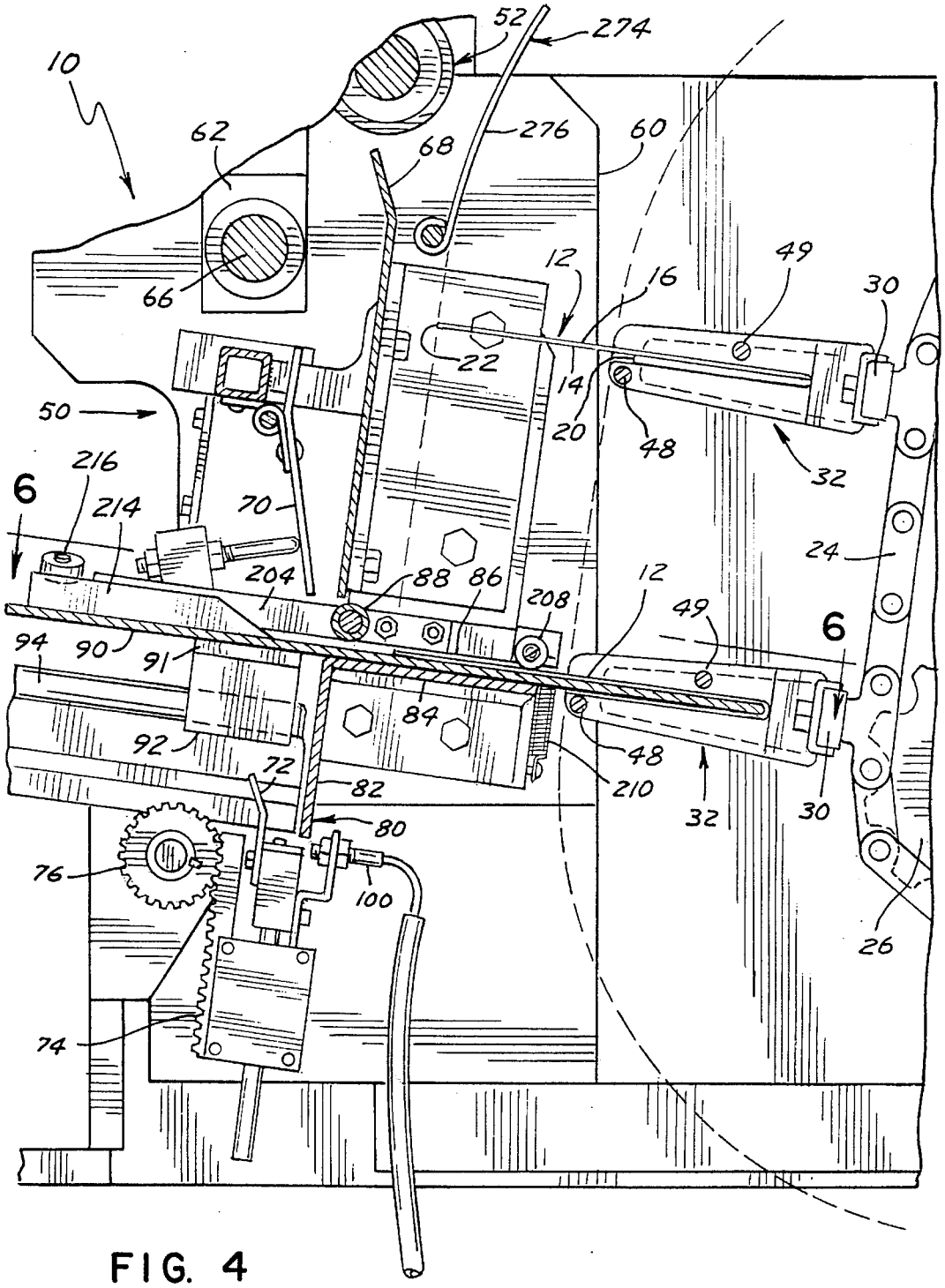
FIG. 4 shows an enlarged cross-sectional view of the microwave popcorn bag folding and loading device of FIG. 3 in a different position.
Figure 5:
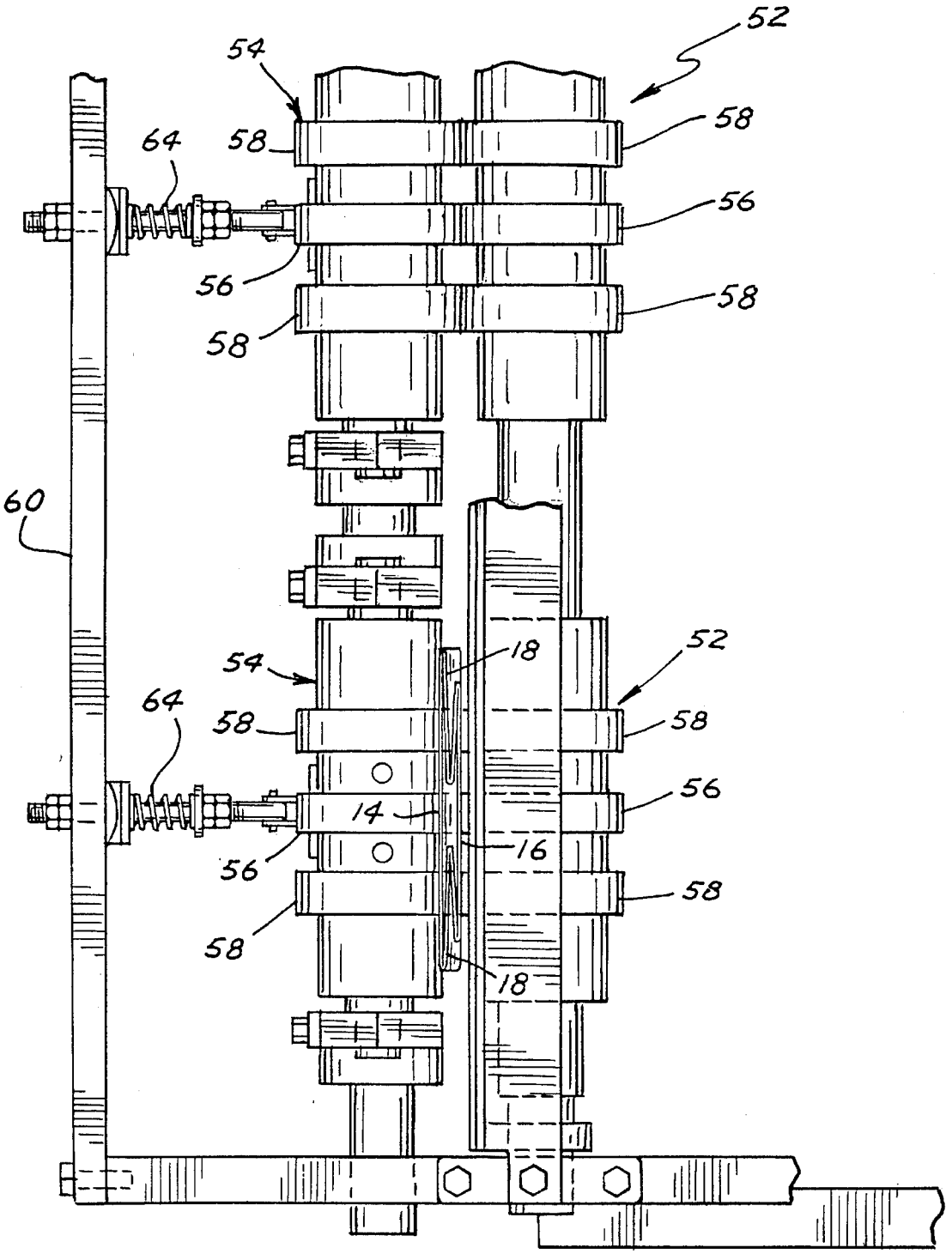
FIG. 5 shows a cross-sectional view of the microwave popcorn bag folding and loading device of FIG. 1 according to section line 5—5 of FIG. 3.
Figure 6:
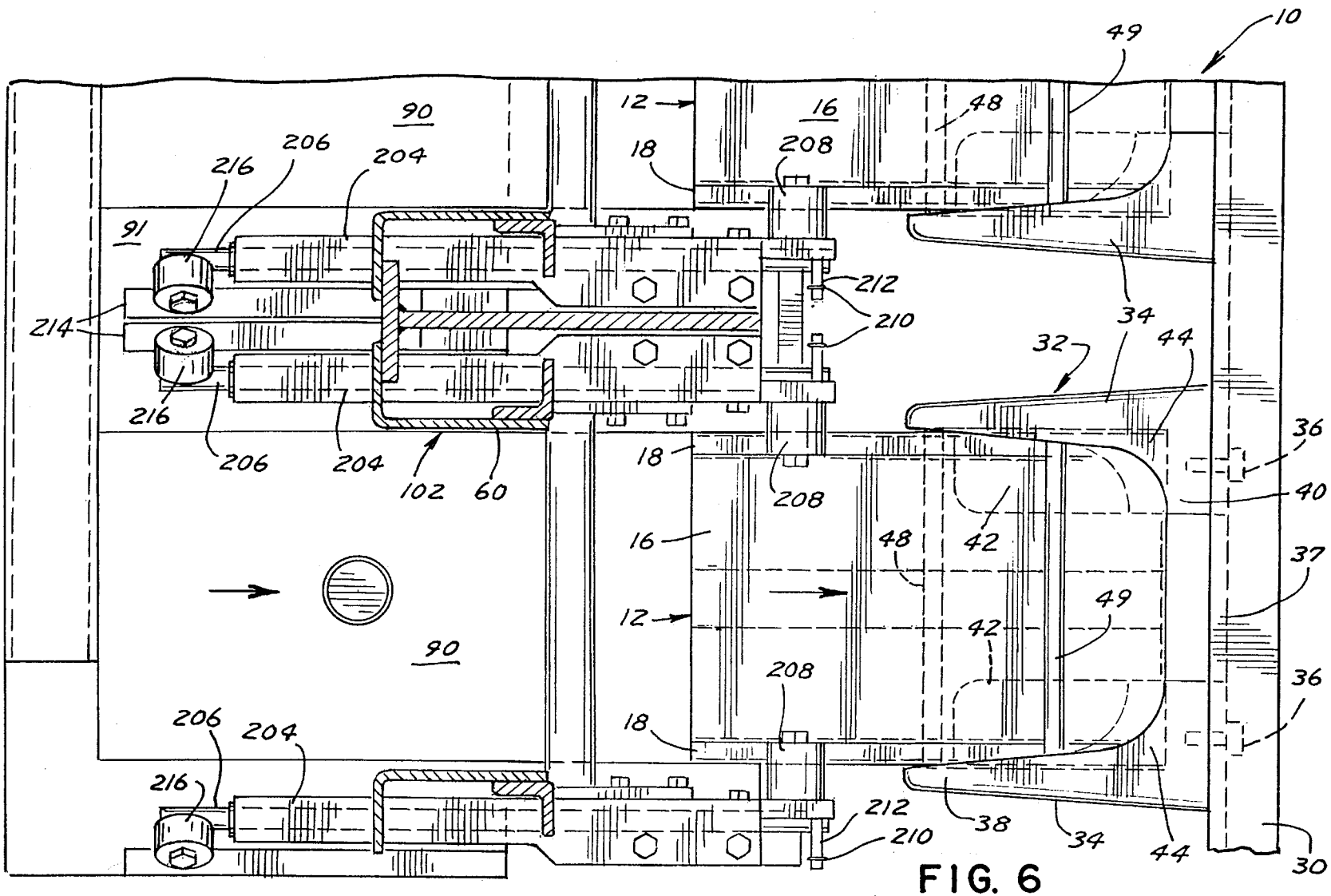
FIG. 6 shows cross-sectional view of the microwave popcorn bag folding and loading device of FIG. 1 according to section line 6—6 of FIG. 4.

Apparatus 10 generally includes at least first and second roller chains 24 arranged as closed loops extending around sprockets 26. Multiple carrier bars 30 are provided including first portions secured to roller chains 24 at equal circumferential spacing along the closed loops. Each carrier bar 30 includes a second portion having a plurality of bag-holding fixtures 32 secured thereto corresponding to the number of lanes of bags 12 which are being filled and sealed in apparatus 10, with 4 lanes being provided in apparatus 10 and 4 fixtures 32 being provided on each carrier bar 30 in the preferred form. The first and second portions of bars 30 are removably secured together such as by bolts as best seen in FIG. 4. It can then be appreciated that changeover for different sized bags can be easily accomplished and/or down time is reduced in the event of fixture contamination, breakage, or the like by simply replacing the second portions of bars 30 with fixtures 32 secured thereon. Any cleaning or repair can be accomplished while the second portions of bars 30 and fixtures 32 secured thereon are removed from apparatus 10 and as apparatus 10 continues to operate with other, replacement, second portions of bars 30 and fixtures 32 secured thereon being secured to the first portions of bars 30 secured to roller chains 24.

In the most preferred form, fixtures 32 each include first and second fixture halves 34 secured in a spaced relation to the second portions of bars 30 by suitable means such as bolts 36. An aperture 37 is formed in bars 30 intermediate halves 34 of each fixture 32. Each half 34 includes a side plate 38 and a bottom plate 40 extending generally perpendicular to the bottom ends of plate 38. Each half 34 further includes a support plate 42 of a generally rectangular configuration and extending generally perpendicular to side plates 38 and bottom plate 40. Each half 34 further includes an abutment 44 of a generally L-shaped configuration having a first leg secured and extending generally perpendicular to plate 38 and a second leg secured to and extending generally perpendicular to plate 40. In the most preferred form, the first and second legs of abutment 44 include an arcuate portion at their interconnection. Abutment 44 has arcuate inside edges and provides a camming surface opposite to support plate 42. Support plate 42 and abutment 44 are generally parallel and spaced from each other and form a slot 46 therebetween for receiving the side edges of bag 12. Side plates 38 further include bores for slideably receiving the ends of a folding bar 48, with bar 48 being captured in the bores of side plates 38 of the first and second fixtures halves 34 forming each fixture 32. The forward extent of bar 48 is generally equal to the forward extent of support plates 42 of halves 34 of fixtures 32. The first legs of abutment 44 include bores for slideably receiving the ends of an expansion prevention bar 49, with bar 49 being captured in the bores of abutment 44 of the first and second fixture halves 34 forming each fixture 32.

It can then be appreciated that as roller chains 24 move around sprocket sets 26, bars 30 and fixtures 32 carried thereby are positioned along the closed loop arrangement of roller chains 24, with chains 24 being movable in an operation direction intermittently by any suitable means in the most preferred form.

Apparatus 10 further includes a device 50 for loading bags 12 into fixtures 32, with device 50 folding bags 12 along a fold line as they are loaded into fixtures 32 in the preferred form, and with bags 12 folded into ⅓–⅔ portions in the most preferred form. Device 50 generally includes bag magazines 250 which hold a supply of bags 12 in a generally vertical but slanted condition for each lane of apparatus 10, with bags 12 in the most preferred form having lower ends 20 spaced horizontally outwardly from upper ends 22. An unloading device 252 is provided for removing the front bag 12 in each magazine 250 and placing it in a generally vertical condition. Device 252 includes first and second linkage assemblies on opposite sides of apparatus 10, with each having a generally C-shaped linkage 254 pivotally mounted intermediate its ends to frame 60. The lower, outer end of each C-shaped linkage 254 is pivotally mounted to the lower, outer corner of a triangular-shaped linkage 256. The upper corner of linkage 256 is pivotally mounted to a first end of a straight linkage 258. The second end of linkage 258 is pivotally mounted at an acute angle to the second end of a straight linkage 260. The first end of linkage 260 is pivotally mounted to the upper, inner end of C-shaped linkage 254. A lateral bar 262 extends between linkages 258 on opposite sides of apparatus 10 generally intermediate the ends of linkages 258. Suction cups 264 are attached to lateral bar 262 corresponding to magazines 250. A crank arm 266 has a first end mounted to a rotatable shaft 268. A straight linkage 270 is pivotally mounted to the second end of crank arm 266 and the inner, lower corner of triangular-shaped linkage 256, with the inner, lower corner of linkage 256 being in a nonlinear arrangement with the upper and lower, outer corners of linkage 256. Air cylinder bias members 272 are pivotally mounted to frame 60 and linkages 254 intermediate their lower, outer ends and the pivot to frame 60.

To remove bags 12 from magazines 250, shaft 268 is rotated by any suitable means such as a crank arm. Rotation of shaft 268 causes pivoting of crank arm 266 which in turn causes pivoting of triangular-shaped linkage 254 due to the pivotal interconnection therebetween by linkage 270. Pivoting of linkage 254 causes bar 262 to move to engage suction cups 264 to bags 12, and move bags 12 from a generally vertical but slanted condition from magazines 250 to a generally vertical condition in front of magazines 250, with the lower ends 20 located generally vertically below upper ends 22. In the most preferred form, bags 12 are released from suction cups 264 by discontinuing the vacuum to suction cups 264 and providing pressurized air thereto in the most preferred form to blow off and actively release bags 12 from suction cups 264.

Device 50 further generally includes first and second nip rollers 52 and 54. Rollers 52 and 54 each include a center wheel 56 and first and second edge wheels 58 located on opposite sides of and spaced from center wheel 56. Wheels 56 and 58 of rollers 52 and 54 abut and roll on each other for grabbing bags 12 from unloading device 252 (after release of vacuum and providing pressurized air to suction cups 264) and vertically feeding bags 12 downward. Wheels 56 are located intermediate the side edges of bags 12 and intermediate the inside folds of the top and bottom gussets of sides 18. Wheels 58 are spaced inside the side edges of bag 12, outside of the inside folds of the top and bottom gussets of sides 18, and inside the folds of bottoms 16 and the bottom gussets of sides 18. Particularly, in the most preferred form, wheels 56 and 58 do not sandwich bags 12 at any of the folds between top 14, bottom 16, and sides 18 such that the folds are not sharply creased as bags 12 pass through rollers 52 and 54 and between wheels 56 and 58 thereof.

In the most preferred form, rollers 52 are rotatably mounted to frame 60 of apparatus 10 whereas rollers 54 are movably mounted relative to rollers 52. Specifically, rollers 54 are rotatably mounted to subframes 62 which are pivotally mounted about an axis 66 to frame 60. Subframes 62 are biased by springs 64 extending between frame 60 and subframes 62 for moving rollers 54 towards and resiliently holding rollers 54 against rollers 52. Thus, rollers 54 separate from rollers 52 in the event that more than one bag 12 should be simultaneously fed to the nip of rollers 52 and 54 in any particular lane in apparatus 10.

First, stationary guide flanges 68 are mounted to frame 60 vertically below rollers 52 and second, guide flanges 70 are mounted to frame 60 vertically below rollers 54 and axis 66. In the most preferred form, guide flanges 70 are openable to allow access to the area between flanges 68 and 70. Specifically, flanges 70 in the preferred form are mounted by hinges to a frame portion having a horizontal pivot axis located intermediate the upper and lower ends of flanges 70. Adjustable counterweights are secured to flanges 70 vertically below the horizontal pivot axis for biasing flanges 70 to pivot about the horizontal pivot axis until the upper ends of flanges 70 abut with the frame portion. Access can then be obtained by pivoting the desired flange 70 about the horizontal pivot axis against the bias of the counterweight, if desired, for example to remove jammed bags 12 located between flanges 68 and 70.

Bags 12 are fed vertically downward between flanges 68 and 70 by nip rollers 52 and 54 towards an adjustable bottom stop 72, with sealed ends 20 abutting with stop 72 in the lowermost position of bags 12 in the most preferred form. A rack gear 74 is secured to stop 72 parallel to the movement direction of bags 12 which is vertically downward in the most preferred form and is generally vertically movable by rotation of a spur gear 76. Gear 76 is rotatable about an axis which is perpendicular to the movement direction of bag 12 and specifically which is horizontal in the preferred form and is in gearing relation with rack gear 74. In the most preferred form, rotation of spur gear 76 can be mechanically stopped at set intervals corresponding to the standard lengths of bags 12 which are typically filled in apparatus 10. Positioned above stop 72 and vertically below rollers 2 are L-shaped folding guides 80 having generally vertical legs 82 and generally horizontal legs 84. Located intermediate guides 80 and guide flanges 68 are folding guides 86 extending generally parallel to horizontal legs 84 of folding guides 80. Folding rollers 88 are located on guides 86 intermediate flanges 68 and legs 82. Loading device 50 further includes a pushing or tucking plate 90 for each lane of fixtures 32. Plates 90 have an elongated length terminating in free, generally arcuate-shaped edges and have a width less than the spacing between abutments 44 of fixtues 32. Plates 90 are simultaneously horizontally movable between retracted positions and extended positions extending between horizontal legs 84 and folding guides 86. In the most preferred form, plates 90 are secured to a mount bar 91 in laterally spaced positions corresponding to fixtures 32 on carrier bars 30. Mount bar 91 is longitudinally movably mounted by first and second slide blocks 92 which are slideably mounted on support shafts 94. In the most preferred form, a rack gear secured to mount bar 91 intermediate slide blocks 92 is moved by rotation of a spur gear to slide blocks 92 on shafts 94 to longitudinally move mount bar 91 and plates 90 between their retracted and extended positions.

In operation of loading device 50 according to the most preferred teachings of the present invention and with plates 90 in their retracted positions, bags 12 are moved from a magazine or the like and positioned with ends 20 positioned above and into nip rollers 52 and 54 by unloading device 252. Rotation of nip rollers 52 and 54 grips bags 12 and pulls bags 12 downwardly between flanges 68 and 70 and drives bags 12 downward until ends 20 rest upon stop 72. In the most preferred form, a suitable sensor 100 is positioned to detect the presence of bag 12 in each of the lanes of apparatus 10. If a bag 12 is not detected in one or more of the lanes by sensor 100, operation of apparatus 10 can be modified as desired. For example, operation could be stopped until an operator checks why a bag 12 is not present, places a bag 12 in the previously omitted lane, and manually restarts operation. Alternately, operation of apparatus 10 can continue with the filling and sealing and other operations not being performed for the particular lane(s) where bags 12 are not detected during the normal operation of apparatus 10 for the other lanes, with operation of apparatus 10 being stopped only if bags 12 are not detected in a single lane for a particular number of cycles. With bags 12 resting upon stop 72, bags 12 extend vertically between vertical legs 82 and the free ends of shafts 94 and between flanges 68 and 70 and generally perpendicular to slots 46 of fixtures 32 and to tucking plates 90, with slots 46 located intermediate ends 20 and 22 of bags 12.

With one of the carrier bars 30 positioned in the vertical portion of the closed loop with bag-holding fixtures 32 parallel to and in line with legs 84 and folding guides 86, plates 90 are moved from their retracted positions to their extended positions by sliding blocks 92 on shafts 94. With movement of plates 90, the free edges of plates 90 abut generally perpendicular with tops 14 of bags 12 above ends 20 such as about ⅓above the total length between ends 20 and 22 when bags 12 in their commercialized form are folded into three generally equal portions. Adjustment of stop 72 can be made to accomodate bags 12 of different lengths so that plates 90 abut at the desired position on tops 14 of bags 12. Upon further movement of plates 90, bags 12 will then fold about the free edges of plates 90 in a generally U shape and extend in a folded condition with tops 14 abutting on opposite sides of plates 90 and with bottoms 16 abutting with horizontal legs 84 and folding guides 86. With further movement of plates 90, bags 12 will be driven into slots 46 as they continue to slide with plates 90 into slots 46 of fixtures 32 until the folded edges of bags 12 extending around the free edges of plates 90 are positioned adjacent to bottom plates 40 of fixtures 32 when plates 90 are in their extended positions. Bottoms 16 of the lower third portions of bags 12 abut with support plates 42 of fixtures 32 and the side edges of bottoms 16 of the middle third portions of bags 12 abut with abutments 44. Slots 46 of fixtures 32 have a width generally equal to but slightly larger than the combined thickness of bag 12 folded over itself and of plates 90. Additionally, as previously set forth, the widths of plates 90 are less than the spacing between abutments 44 of fixtures 32. It should then be noted that the side fold edges of bag 12 and the folds of bags 12 about the free ends of plates 90 are not tightly creased by fixtures 32 and plates 90.

Plates 90 are then slid from their extended positions to their retracted positions by sliding blocks 92 on shafts 94 to withdraw plates 90 from slots 46 of fixtures 32, from between legs 84 and guides 86, and from bags 12 to their retracted positions.

To insure that bags 12 do not slide with plates 90 from fixtures 32, a catch mechanism 102 can be provided to engage bags 12 for allowing movement of bags 12 in a direction into fixtures 32 but preventing movement of bags 12 in a direction out of fixtures 32 with plates 90. Mechanism 102 generally includes first and second tubes 204 secured to frame 60 and located on opposite sides of plates 90. A shaft 206 is rotatably mounted inside of each of tubes 204 about an axis generally parallel to the movement direction of plates 90, with shaft 206 including opposite ends extending beyond the opposite ends of tubes 204. The inner end of each shaft 206 includes a compression roller 208 rotatable about an axis extending generally perpendicular to shaft 206. In the most preferred form, roller 208 is rotatable in only one direction about its axis and is unable to rotate about its axis in the opposite direction. Rotation of shaft 206 in tube 204 moves roller 208 from a first position generally engaging horizontal leg 84 and a second position generally spaced from horizontal leg 84. In the most preferred form, shaft 206 is biased from the first position to the second position by a spring 210 extending from frame 60 to a pin 212 extending perpendicular to shaft 206 in the opposite diametric direction than the axis of roller 208. For rotating shaft 206 against the bias of spring 210, a cam 214 is secured to mount bar 91 for each shaft 206. A cam follower 216 is rotatably mounted to the outer end of each shaft 206 about an axis generally perpendicular to shaft 206 and the axis of roller 208. Cams 214 move shaft 206 and rollers 208 between their second positions to their first positions just as plates 90 enter and leave the extended positions. Thus, rollers 208 briefly sandwich the opposite edges of bags 12 against horizontal leg 84 and outward of plates 90. In the most preferred form, rollers 208 rotate to roll on bags 12 as plates 90 move in the direction from their retracted positions to their extended positions but are not able to rotate or roll on bags 12 as plates 90 move in the direction from their extended positions to their retracted positions. Thus, rollers 208 hold bags 12 from initially moving with plates 90 as plates 90 move from their extended positions to their retracted positions. The sandwiching of the edges of bags 12 and the inability of rollers 208 to rotate and roll on bags 12 during the retraction of plates 90 hold bags 12 from moving with plates 90 as they initially move, with bags 12 typically not retracting from fixtures 32 with plates 90 with the release of rollers 208 after plates 90 are already in motion. In the most preferred form, compression of the edges of bag 12 is limited and minimized to a small length thereof by rollers 208. Although mechanism 102 is shown in the most preferred form, other methods of keeping bags 12 from sliding from fixtures 32 with plates 90 can be utilized including but not limited to ratchet-type catches which allow entry but prevent movement in the opposite direction.

After plates 90 have been retracted from fixtures 32, chains 24 can be advanced to move carrier bars 30 from the vertical portions of the closed loop, with the advancement of fixtures 32 pulling any remaining portions of bags 12 still positioned between legs 84 and guides 86.

Stationary guides 274 are attached to frame 60 to prevent bags 12 from moving from slots 46 of fixtures 32 under centrifugal forces as fixtures 32 move from the vertical portion to the horizontal portion of the closed loops of roller chains 24. Guides 274 include a first arcuate portion 276 which abuts with open ends 22 of bags 12 as they move around portions of the closed loops wherein change of direction from generally vertical to generally horizontal occurs.

It should be appreciated that various overload protection devices can be utilized to stop operation of apparatus 10 or a particular station thereof in the event of a jam or other interruption in the unloading, loading, and/or folding operation.

Now that the basic construction and operation of apparatus 10 according to the preferred teachings of the present invention have been explained, many extensions and variations may be obvious to a person skilled in the art. For example, although fixtures 32 have been shown and described as being formed of nonmovable parts, fixtures 32 can be of a hinged type which include legs which are openable and closeable. For example, the legs could be biased by springs to a normally closed position and can be cammed open against the bias of the springs. Vacuum suction cups could be provided to the legs of the fixtures to attach to the bag surfaces for opening with bags when the legs are hinged open, with the suction cups being continuously under vacuum or intermittently under vacuum only in the task positions where opening of the bag is desired. The legs of fixtures 32 can be shaped to correspond to the filled shape of bags 12.

Likewise, fixtures 32 could include a spring or like clamping member which sandwiches bags 12 in fixtures 32 to prevent bags 12 from slipping out of fixtures 32 during movement of fixtures 32 about the parallelogram shape of the closed loops. Suitable apparatus such as suction cups may be necessary to pull back such spring or clamping member during filling or removal operations.

Further, although bags 12 have been described having a closed end 20 in the most preferred form, tubes can be provided with ends 20 being closed by a suitable sealing device associated with or adjacent to bottom stop Similarly, bags 12 having side edges which are not sealed can be provided which are sealed prior to or at the time of loading into fixtures 32.

Although bags 12 have been described in the most preferred form as microwave popcorn popping bags 12 and specifically are folded into a central portion having first and second wing portions and in the most preferred form into thirds, bags 12 could be loaded into fixtures 32 in an unfolded condition where bags 12 are not desired to be folded in the final form. Similarly, bags 12 could be filled with other types of product than popcorn kernels such as but not limited to baking ingredients such as cake mixes, sauces such as catsup, and the like.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Device for loading a bag into a fixture having a slot formed therein, with the bag including lower and upper ends, first and second side edges, and first and second gusseted sides having inner folds, comprising, in combination: means for positioning the bag generally perpendicular to the slot of the fixture with the slot of the fixture located intermediate the upper and lower ends of the bag; and a tucking plate movable between a retracted position and an extended position, with the tucking plate insertable in the slot of the fixture for driving the bag into the slot of the fixture and creating a fold in the bag when the tucking plate moves from the retracted position to the extended position with the bag having a U-shaped configuration around the tucking plate; wherein the positioning means includes first and second nip rollers, with each of the nip rollers including first, second and third wheels which abut and roll on each other for engaging the bag intermediate the side edges, with the first wheel engaging the bag intermediate the inner folds of the first and second gusseted sides, with the second wheel engaging the bag intermediate the inner fold of the first gusseted side and the first side edge, and with the third wheel engaging the bag intermediate the inner fold of the second gusseted side and the second side edge.

2. Device for loading a bag having lower and upper ends into a fixture having a slot formed therein comprising, in combination: means for positioning the bag generally perpendicular to the slot of the fixture with the slot of the fixture located intermediate the upper and lower ends of the bag; and a tucking plate movable between a retracted position and an extended position, with the tucking plate insertable in the slot of the fixture for driving the bag into the slot of the fixture and creating a fold in the bag when the tucking plate moves from the retracted position to the extended position with the bag having a U-shaped configuration around the tucking plate; wherein the positioning means includes a first folding guide and a second folding guide spaced from each other corresponding to and complementary to the slot of the fixture, with the second folding guide including a folding roller for rolling support of the bag generally perpendicular to the slot and parallel to the slot with the insertion of the tucking plate.

3. The bag loading device of claim 2 wherein the first folding guide is generally L-shaped and includes a first leg extending generally perpendicular to the slot of the fixture and a second leg extending generally parallel to the slot of the fixture.

4. Device for loading a bag into a movable fixture, with the bag having lower and upper ends and first and second side edges, with the fixture including first and second fixture halves and means for holding the first and second fixture halves in a spaced relation, with the first and second fixture halves each having a side slot formed therein, comprising, in combination: means for positioning the bag generally perpendicular to the side slots of the fixture halves with the side slots of the fixture halves located intermediate the upper and lower ends of the bag; and a tucking plate movable between a retracted position and an extended position, with the width between the first and second side edges of the bag being larger than the width of the tucking plate, with the tucking plate having a width less than the spacing between the side slots of the first and second fixture halves, with the tucking plate driving the first side edge of the bag into and for receipt within the side slot of the first fixture half and the second side edge of the bag into and for receipt within the side slot of the second fixture half and creating a fold in the bag when the tucking plate moves from the retracted position to the extended position with the bag having a U-shaped configuration around the tucking plate.

5. The bag loading device of claim 4 further comprising, in combination: means for preventing movement of the bag with the tucking plate as the tucking plate moves from the extended position to the retracted position; wherein the positioning means includes a leg extending generally parallel to the side slots of the fixture halves, with the first and second side edges extending parallel to the movement direction of the tucking plate between the retracted and extended positions; and wherein the preventing means comprises means for sandwiching at least one of the first and second side edges against the leg at a location spaced outwardly of the tucking plate in a direction perpendicular to the movement direction of the tucking plate and without sandwiching the portions of the bag extending over the tucking plate against the tucking plate.

6. The bag loading device of claim 5 wherein the sandwiching means comprises means for sandwiching one of the first and second side edges against the leg during only a substantially minor portion of the movement of the tucking plate between the retracted and extended positions and when the tucking plate is in or closely adjacent the extended position, with the sandwiching means being spaced from the leg during the remaining portions of the movement of the tucking plate.

7. The bag loading device of claim 6 wherein the sandwiching means comprises, in combination: a compression roller movable from a first position generally engaging the leg and a second position generally spaced from the leg; and means carried by the tucking plate for moving the compression roller from the second position to the first position.

8. The bag loading device of claim 7 wherein the sandwiching means further comprises, in combination: a shaft rotatable about an axis generally parallel to the movement direction of the tucking plate, with the compression roller being rotatably mounted to the shaft; a cam follower mounted to the shaft; and means for biasing the compression roller from the first position to the second position; and wherein the moving means comprises a cam mounted to the tucking plate for engaging the cam follower to rotate the shaft and the compression roller mounted thereto about the axis.

9. The bag loading device of claim 4 wherein the holding means comprises a carrier bar movable along a closed loop, with the first and second fixture halves being secured to the carrier bar.

10. Device for loading a bag having lower and upper ends into a fixture having a slot formed therein comprising, in combination: means for positioning the bag generally perpendicular to the slot of the fixture with the slot of the fixture located intermediate the upper and lower ends of the bag; and a tucking plate movable between a retracted position and an extended position, with the tucking plate insertable in the slot of the fixture for driving the bag into the slot of the fixture and creating a fold in the bag when the tucking plate moves from the retracted position to the extended position with the bag having a U-shaped configuration around the tucking plate; and means for removing the front bag from a supply of bags held in a magazine, with the lower ends of the bags being spaced horizontally outward from the upper ends of the bags in the magazine comprising a linkage assembly comprising, in combination: a first, C-shaped linkage having a lower end and an upper end, with the first, C-shaped linkage being pivotally mounted about an axis intermediate the lower and upper ends; a second linkage having a first end and a second end, with the first end of the second linkage being pivotally mounted to the upper end of the first, C-shaped linkage; a third linkage having a first end and a second end, with the first end of the third linkage being pivotally mounted to the second end of the second linkage; a fourth linkage having an upper end and a lower end, with the lower end of the fourth linkage being pivotally mounted to the lower end of the first linkage, with the upper end of the fourth linkage being pivotally mounted to the second end of the third linkage; means carried by the third linkage for releasably attaching to the front bag; and means for moving one of the first, second, third and fourth linkages for pivoting the first, second, third and fourth linkages relative to each other between a first position with the releasably attaching means engaging with the front bag held in the magazine and a second position with the front bag in a generally vertical condition in front of the magazine.

11. The bag loading device of claim 10 wherein the fourth linkage is triangular shaped and includes a corner in a nonlinear arrangement with the upper and lower ends; and wherein the pivoting means comprises, in combination: a fifth linkage pivotally connected to the corner of the fourth linkage; and means for moving the fifth linkage.

12. The bag loading device of claim 11 wherein the first and second linkage assemblies are provided; and wherein the releasably attaching means comprises a lateral bar extending between the third linkages of the first and second linkage assemblies; and suction cups attached to the lateral bar.

13. Device for loading a bag into a fixture having a slot formed therein, with the bag having lower and upper ends and first and second side edges, comprising, in combination: a tucking plate movable in a movement direction between a retracted position and an extended position, with the tucking plate insertable in the slot of the fixture for driving the bag into the slot of the fixture when the tucking plate moves from the retracted position to the extended position; means for preventing movement of the bag with the tucking plate as the tucking plate moves from the extended position to the retracted position; and a leg extending generally parallel to the slot of the fixture, with the first and second side edges extending parallel to the movement direction, with the width between the first and second side edges of the bag being larger than the width of the tucking plate; and wherein the preventing means comprises means for sandwiching at least one of the first and second side edges against the leg at a location spaced outwardly of the tucking plate in a direction perpendicular to the movement direction of the tucking plate and without sandwiching the portions of the bag extending over the tucking plate against the tucking plate.

14. The bag loading device of claim 13 wherein the sandwiching means comprises means for sandwiching at least one of the first and second side edges against the leg during only a substantially minor portion of the movement of the tucking plate between the retracted and extended positions and when the tucking plate is in or closely adjacent the extended position, with the sandwiching means being spaced from the leg during the remaining portions of the movement of the tucking plate.

15. The bag loading device of claim 14 wherein the sandwiching means comprises, in combination: a compression roller movable from a first position generally engaging the leg and a second position generally spaced from the leg; and means carried by the tucking plate for moving the compression roller from the second position to the first position.

16. The bag loading device of claim 15 wherein the sandwiching means further comprises, in combination: a shaft rotatable about an axis generally parallel to the movement direction of the tucking plate, with the compression roller being rotatably mounted to the shaft; a cam follower mounted to the shaft; and means for biasing the compression roller from the first position to the second position; and wherein the moving means comprises a cam mounted to the tucking plate for engaging the cam follower to rotate the shaft and the compression roller mounted thereto about the axis.

17. Device for removing a front bag from a supply of bags held in a magazine, with the bags having lower ends spaced horizontally outward from their upper ends in the magazine comprising a linkage assembly comprising, in combination: a first, C-shaped linkage having a lower end and an upper end, with the first, C-shaped linkage being pivotally mounted about an axis intermediate the lower and upper ends; a second linkage having a first end and a second end, with the first end of the second linkage being pivotally mounted to the upper end of the first, C-shaped linkage; a third linkage having a first end and a second end, with the first end of the third linkage being pivotally mounted to the second end of the second linkage; a fourth linkage having an upper end and a lower end, with the lower end of the fourth linkage being pivotally mounted to the lower end of the first linkage, with the upper end of the fourth linkage being pivotally mounted to the second end of the third linkage; means carried by the third linkage for releasably attaching to the front bag; and means for moving one of the first, second, third and fourth linkages for pivoting the first, second, third and fourth linkages relative to each other between a first position with the releasably attaching means engaging with the front bag held in the magazine and a second position with the front bag in a generally vertical condition in front of the magazine.

18. The bag removing device of claim 17 wherein the fourth linkage is triangular shaped and includes a corner in a nonlinear arrangement with the upper and lower ends; and wherein the pivoting means comprises, in combination: a fifth linkage pivotally connected to the corner of the fourth linkage; and means for moving the fifth linkage.

19. The bag removing device of claim 18 wherein the moving means comprises, in combination: a crank arm having a first end and a second end, with the first end being pivotally mounted to an axis spaced from and parallel to the axis of the C-shaped linkage, with the second end being pivotally connected to the fifth linkage.

20. The bag removing device of claim 19 wherein the second and third linkages are straight.

21. The bag removing device of claim 18 wherein the first and second linkage assemblies are provided; and wherein the releasably attaching means comprises a lateral bar extending between the third linkages of the first and second linkage assemblies; and suction cups attached to the lateral bar.

22. Device for loading a bag having lower and upper ends into a fixture having a slot formed therein comprising, in combination: a tucking plate movable between a retracted position and an extended position, with the tucking plate insertable in the slot of the fixture for driving the bag into the slot of the fixture when the tucking plate moves from the retracted position to the extended position; a leg extending generally parallel to the slot of the fixture; and means for preventing movement of the bag with the tucking plate as the tucking plate moves from the extended position to the retracted position comprising means for sandwiching at least a portion of the bag against the leg during only a substantially minor portion of the movement of the tucking plate between the retracted and extended positions and when the tucking plate is in or closely adjacent the extended position and without sandwiching the bag during the remaining portions of the movement of the tucking plate to and from the extended position.

23. The bag loading device of claim 22 wherein the sandwiching means comprises, in combination: a compression roller movable from a first position generally engaging the leg and a second position generally spaced from the leg; and means carried by the tucking plate for moving the compression roller from the second position to the first position.

24. The bag loading device of claim 23 wherein the sandwiching means further comprises, in combination: a shaft rotatable about an axis generally parallel to the movement direction of the tucking plate, with the compression roller being rotatably mounted to the shaft; a cam follower mounted to the shaft; and means for biasing the compression roller from the first position to the second position; and wherein the moving means comprises a cam mounted to the tucking plate for engaging the cam follower to rotate the shaft and the compression roller mounted thereto about the axis.

25. Method for loading a bag into a fixture having a slot formed therein, with the bag having first and second side edges, comprising the steps of: positioning a bag relative to the slot; driving the bag into the slot of the fixture, with the driving step comprising the step of engaging the bag with a tucking plate moving from a retracted position to an extended position with the tucking plate being inserted into the slot; moving the tucking plate from the extended position to the retracted position; and preventing movement of the bag with the tucking plate as the tucking plate moves from the extended position to the retracted position, with the preventing step comprising the step of sandwiching at least one of the first and second side edges against a leg at a location spaced outward of the tucking plate in a direction perpendicular to the movement direction of the tucking plate and without sandwiching the portions of the bag extending over the tucking plate against the tucking plate.

26. The bag loading method of claim 25 wherein the sandwiching step comprises the step of sandwiching at least one of the first and second side edges against the leg during only a substantially minor portion of the movement of the tucking plate between the retracted and extended positions and when the tucking plate is in or closely adjacent the extended position and without sandwiching the bag during the remaining portions of the movement of the tucking plate.

27. The bag loading method of claim 26 wherein the sandwiching step comprises the step of moving a compression roller from a first position generally engaging the leg and a second position generally spaced from the leg, with the compression roller moving from the second position to the first position due to the movement of the tucking plate from the retracted position to the extended position.

28. The bag loading method of claim 27 wherein the compression roller moving step comprises the steps of: providing a shaft rotatable about an axis generally parallel to the movement direction of the tucking plate, with the compression roller being rotatably mounted to the shaft; biasing the compression roller from the first position to the second position; and rotating the shaft and the compression roller mounted thereto about the axis.

29. Method for loading a bag into a fixture having a slot formed therein, with the bag having first and second side edges, comprising the steps of: positioning a bag relative to the slot; driving the bag into the slot of the fixture, with the driving step comprising the step of engaging the bag with a tucking plate moving from a retracted position to an extended position with the tucking plate being inserted into the slot; moving the tucking plate from the extended position to the retracted position; and preventing movement of the bag with the tucking plate as the tucking plate moves from the extended position to the retracted position, with the preventing step comprising the step of sandwiching the bag against the leg during only a substantially minor portion of the movement of the tucking plate between the retracted and extended positions and when the tucking plate is in or closely adjacent the extended position and without sandwiching the bag during the remaining portions of the movement of the tucking plate to and from the extended position.

30. The bag loading method of claim 29 wherein the sandwiching step comprises the step of moving a compression roller from a first position generally engaging the leg and a second position generally spaced from the leg, with the compression roller moving from the second position to the first position due to the movement of the tucking plate from the retracted position to the extended position.

31. The bag loading method of claim 30 wherein the compression roller moving step comprises the steps of: providing a shaft rotatable about an axis generally parallel to the movement direction of the tucking plate, with the compression roller being rotatably mounted to the shaft; biasing the compression roller from the first position to the second position; and rotating the shaft and the compression roller mounted thereto about the axis.

* * * * *

UNITED STATES PATENT AND TRADEMARK OFFICE

CERTIFICATE OF CORRECTION

PATENT NO. : 5,480,372

DATED : January 2, 1996

INVENTOR(S) : Rodney K. Gwiazdon, John E. Korte, Richard S. Deadmond, Wayne A. Smith It is certified that error appears in the above-identified patent and that said Letters Patent is hereby corrected as shown below:

Col. 3, line 2; "preferred away" should be -- preferred teachings of the present invention, with portions broken away --;

line 16; "shows cross-" should be -- shows a cross- --;

line 23; "of heart" should be -- of the art --;

Col. 6, line 31; "2" should be -- 52 --;

Col. 9, line 17; "stop Similarly," should be --stop 72. Similarly--.

Signed and Sealed this

Twenty-eighth Day of May, 1996

Bruce Lehman

*Attest:*

BRUCE LEHMAN

*Attesting Officer*

*Commissioner of Patents and Trademarks*